US006198055B1

(12) United States Patent
Hughes

(10) Patent No.: US 6,198,055 B1
(45) Date of Patent: Mar. 6, 2001

(54) MANUALLY MOVABLE SWITCH SELECTOR INCLUDING BOTH A ROTARY KNOB AND A THUMB WHEEL

(75) Inventor: Timothy E. Hughes, Livonia, MI (US)

(73) Assignee: TRW Inc., Lyndhurst, OH (US)

( * ) Notice: Subject to any disclaimer, the term of this patent is extended or adjusted under 35 U.S.C. 154(b) by 0 days.

(21) Appl. No.: 09/235,573

(22) Filed: Jan. 22, 1999

(51) Int. Cl.[7] ..... H01H 3/08

(52) U.S. Cl. ..... 200/14; 16/441; 74/553; 200/11 TW; 200/50.34

(58) Field of Search ..... 200/11 TW, 14, 200/7, 50.32, 50.34, 18, 336; 74/10.45, 553; 16/441

(56) References Cited

U.S. PATENT DOCUMENTS

| | | | | |
|---|---|---|---|---|
| 2,727,406 | * | 12/1955 | Opocensky | 74/553 X |
| 4,520,240 | * | 5/1985 | Swindler | 200/18 R X |
| 5,128,503 | * | 7/1992 | Frantz | 200/336 |
| 5,180,050 | | 1/1993 | Rada et al. . | |
| 5,204,502 | | 4/1993 | Ferris et al. . | |

* cited by examiner

*Primary Examiner*—Renee Luebke
(74) *Attorney, Agent, or Firm*—Tarolli, Sundheim, Covell, Tummino & Szabo L.L.P.

(57) ABSTRACT

A manually movable switch selector (14) includes a rotary knob (16) and a thumb wheel (18). The rotary knob (16) is configured for rotation about a first axis (19). The thumb wheel (18) is supported on the rotary knob (16) for rotation relative to the rotary knob (16) about a second axis (29) perpendicular to the first axis (19).

10 Claims, 2 Drawing Sheets

MANUALLY MOVABLE SWITCH SELECTOR INCLUDING BOTH A ROTARY KNOB AND A THUMB WHEEL

FIELD OF THE INVENTION

The present invention relates to a manually operable electrical switch, and particularly relates to a switch mounted on a vehicle instrument panel.

BACKGROUND OF THE INVENTION

A vehicle instrument panel is equipped with a plurality of electrical switches that are operable manually. For example, a headlight switch may have a rotary knob for turning the headlights on and off. A switch for the interior lights may have a thumb wheel for dimming or brightening the interior lights.

SUMMARY OF THE INVENTION

In accordance with the present invention, a manually movable switch selector comprises a rotary knob and a thumb wheel. The rotary knob is configured for rotation about a first axis. The thumb wheel is supported on the rotary knob for rotation relative to the rotary knob about a second axis perpendicular to the first axis.

BRIEF DESCRIPTION OF THE DRAWINGS

The foregoing and other features of the present invention will become apparent to those skilled in the art to which the present invention relates upon reading the following description with reference to the accompanying drawings, wherein.

DESCRIPTION OF A PREFERRED EMBODIMENT

Figure 1:
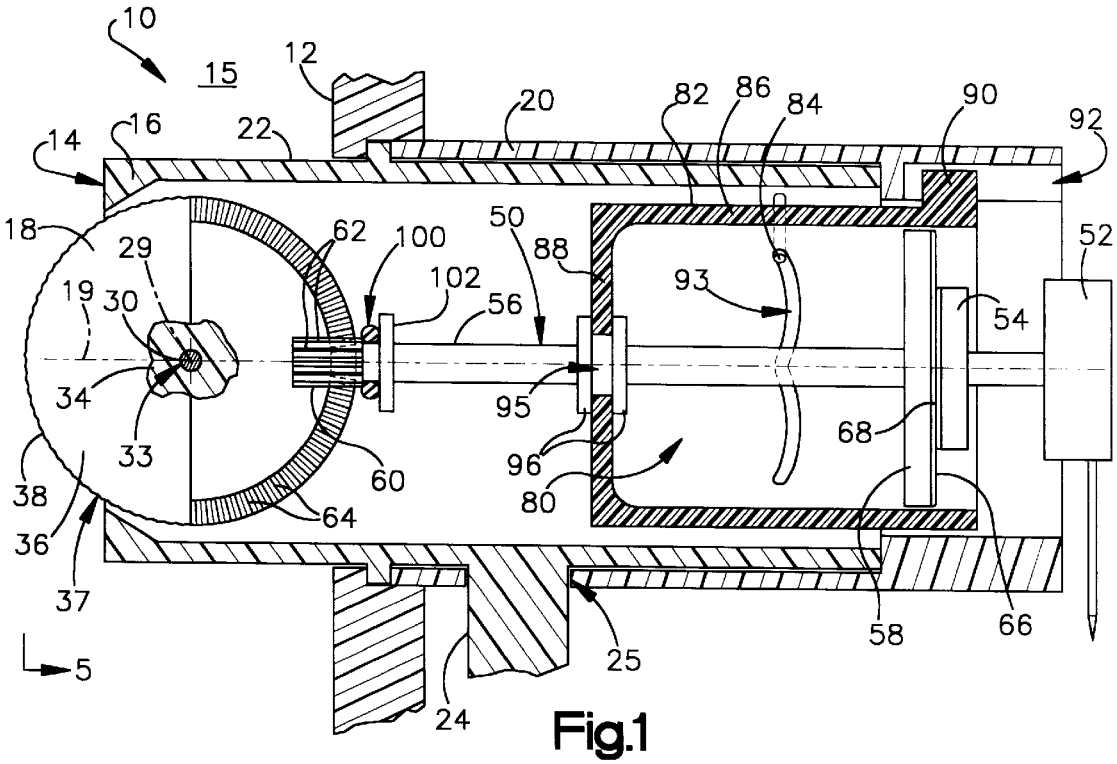
FIG. 1 is a side view, fully in section, of an apparatus comprising a preferred embodiment of the present invention.

An apparatus including a preferred embodiment of the present invention is shown in FIG. 1. The apparatus includes a switch 10 that is mounted in a vehicle instrument panel 12. A manually movable selector portion 14 of the switch 10 projects from the instrument panel 12 into the vehicle occupant compartment 15. In accordance with the present invention, the selector 14 includes both a rotary knob 16 and a thumb wheel 18.

The rotary knob 16 in the preferred embodiment of the present invention is an elongated, hollow cylindrical part with a longitudinal central axis 19. A housing 20 for the knob 16 is fixed to the instrument panel 12. The housing 20 also is an elongated, hollow cylindrical part centered on the axis 19. The knob 16 is received closely within the housing 20, and has a cylindrical outer surface portion 22 for grasping by a vehicle occupant. The knob 16 is thus supported by the housing 20 for rotation about the axis 19 relative to the instrument panel 12.

An actuator arm 24 on the knob 16 projects radially outward through a slot 25 in the housing 20. The slot 25 is elongated circumferentially relative to the housing 20, with the length of the slot 25 defining a range through which the actuator arm 24 is movable circumferentially upon rotation of the knob 16 in the housing 20. The actuator arm 24 is engageable with an electrical device (not shown) to switch the device between a plurality of differently actuated conditions upon rotation of the knob 16 between a corresponding plurality of selectable positions. Such switching may occur in any suitable manner known in the art, and any suitable detent mechanism may be used to retain the knob 16 releasably in each of its selectable positions.

The thumb wheel 18 has a central axis of rotation 29. The axis 29 of the thumb wheel 18 intersects, and is perpendicular to, the axis 19 of the knob 16. A pair of stub shafts 30, one of which is shown in FIG. 1, project from the thumb wheel 18 in opposite directions along the axis 29. The stub shafts 30 are received closely within a corresponding pair of bores 33 (one of which also is shown in FIG. 1) in adjoining bearing portions 34 of the knob 16. An outer portion 36 of the thumb wheel 18 projects radially through a slot 37 in the knob 16. The outer portion 36 of the thumb wheel 18 has a peripheral edge surface 38 for engagement by the thumb of a vehicle occupant. The thumb wheel 18 is thus supported on the knob 16 for rotation about the axis 19 with the knob 16, and also for rotation about the axis 29 relative to the knob 16.

The switch 10 further includes an actuator structure 50 which extends from the thumb wheel 18 to a corresponding electrical device 52. In the preferred embodiment of the present invention, the electrical device 52 is a rotary potentiometer with an input disk 54 centered on the axis 19. The output of the potentiometer 52 varies upon rotation of the input disk 54. Accordingly, the actuator structure 50 in the preferred embodiment comprises a torque arm 56 and an actuator disk 58 for rotating the input disk 54 in response to rotation of the thumb wheel 18.

An outer end portion 60 of the torque arm 56 has gear teeth 62 that mesh with gear teeth 64 on the thumb wheel 18. When the thumb wheel 18 is rotated about the axis 29, the gear teeth 64 and 62 rotate the torque arm 56 and the actuator disk 58 about the axis 19. A frictional driving surface 66 on the actuator disk 58 engages a frictional driven surface 68 on the input disk 54 without slipping so as to rotate the input disk 54 equally about the axis 19.

A vehicle occupant may inadvertently rotate the thumb wheel 18 about the axis 29 while intentionally rotating the knob 16 about the axis 19. In accordance with a particular feature of the present invention, the switch 10 permits such inadvertent rotation of the thumb wheel 18 to occur without changing the output of the potentiometer 52. This is accomplished by the operation of a linkage 80 which is connected between the knob 16 and the thumb wheel 18. Specifically, the linkage 80 operates to switch the thumb wheel 18 out of actuatable engagement with the potentiometer 52 upon rotation of the knob 16.

The torque arm 56 is part of the linkage 80. Other parts of the linkage 80 include a sliding clutch 82 and a linkage pin 84. The clutch 82 is a cup-shaped part with a cylindrical side wall 86 and a circular end wall 88 centered on the axis 19. A key 90 on the side wall 86 projects radially into a slot 92 in the housing 20. The slot 92 is elongated in a direction parallel to the axis 19. In this arrangement, the key 90 enables the clutch 82 to slide along the axis 19 but blocks the clutch 82 from rotating about the axis 19.

The linkage pin 84 projects radially inward from the knob 16 through a serpentine slot 93 in the side wall 86 of the clutch 82. When the knob 16 is rotated from one toward another of its selectable positions, the linkage pin 84 moves circumferentially around the axis 19. However, since the key 90 blocks the clutch 82 from rotating about the axis 19, the linkage pin 84 acts as a cam in the slot 93 so as to shift the clutch 82 axially relative to the knob 16. For example, when the linkage pin 84 is moved circumferentially from the position of FIG. 1 to the position of FIG. 2, the clutch 82 is shifted axially from the position of FIG. 1 to the position of FIG. 2.

The torque arm 56 extends through an aperture 95 in the end wall 88 of the clutch 82. A pair of flanges 96 on the torque arm 56 project radially outward of the aperture 95 on opposite sides of the end wall 88. The flanges 96 permit the torque arm 56 to rotate about the axis 19 relative to the clutch 82, but constrain the torque arm 56 to move axially with the clutch 82. Accordingly, when the clutch 82 is shifted axially from the position of FIG. 1 toward the position of FIG. 2, as described above, the torque arm 56 and the actuator disk 58 are shifted axially out of engagement with the input disk 54 at the potentiometer 52. The thumb wheel 18 can then be rotated about the axis 29 without affecting the output of the potentiometer 52.

Figure 2:
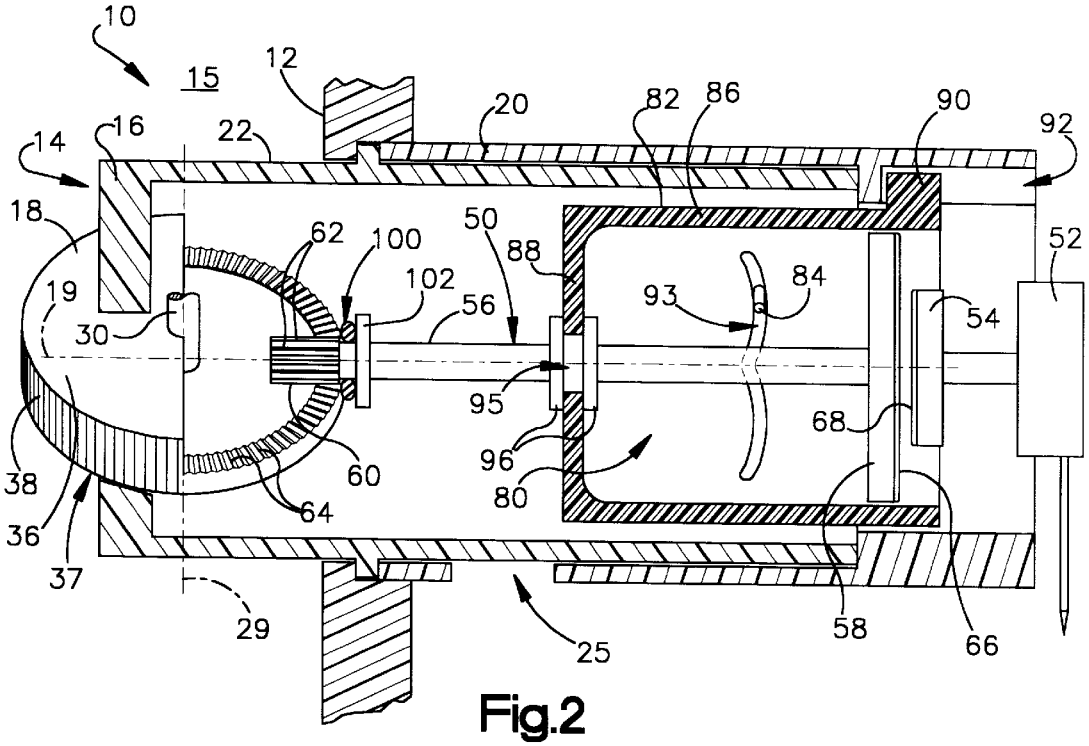
FIG. 2 is a view similar to FIG. 1 showing parts in different positions.
Figure 3:
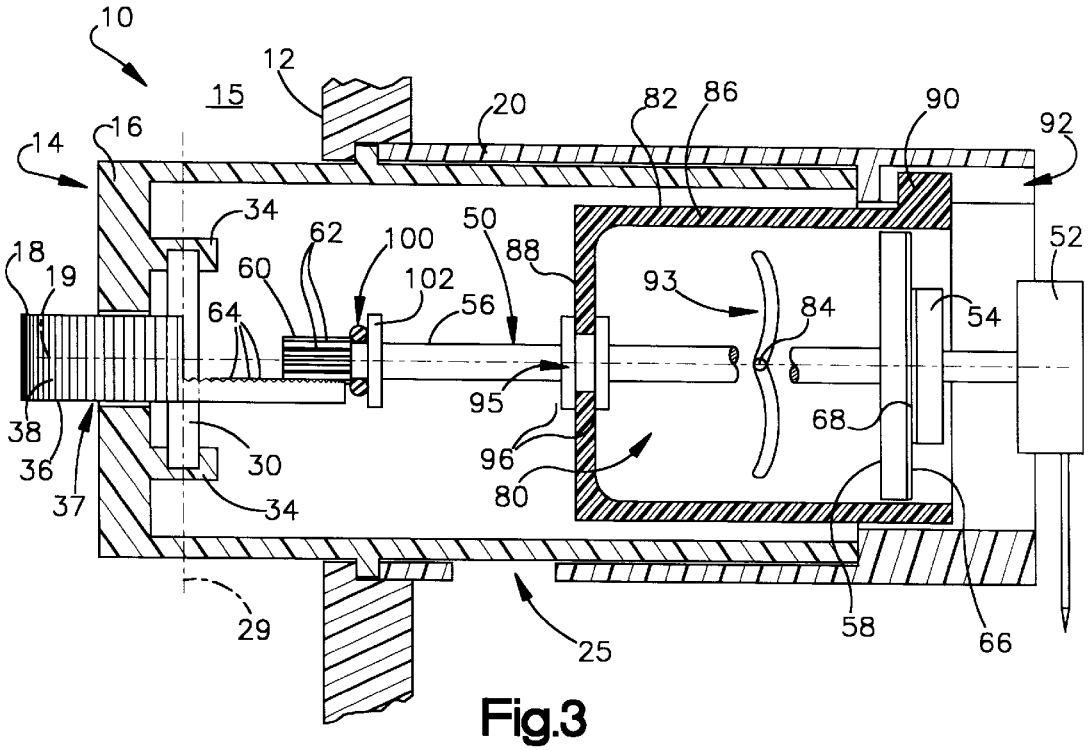
FIG. 3 also is a view similar to FIG. 1 showing parts in different positions.

When the knob 16 is in the position of FIG. 2, it is midway between one of its selectable positions (FIG. 1) and a next adjacent selectable position (FIG. 3). The slot 93 in the clutch 82 is configured such that further rotation of the knob 16 from the position of FIG. 2 to the position of FIG. 3 will cause the linkage pin 84 to shift the clutch 82 axially back to the same position in which it is shown in FIG. 1. The torque arm 56 and the actuator disk 58, and hence the thumb wheel 18, are thus switched back into actuatable engagement with the potentiometer 52 when the knob 16 is rotated fully to another of its selectable positions.

The preferred embodiment of the present invention further includes a braking device in the form of an elastomeric O-ring 100. The O-ring 100 is received over the torque arm 56 at a location between the thumb wheel 18 and an adjacent flange 102 on the torque arm 56. When the torque arm 56 is being shifted from the position of FIG. 1 to the position of FIG. 2, the flange 102 presses the O-ring 100 against the peripheral edge surface 38 of the thumb wheel 18 firmly enough for the O-ring 100 to block or at least restrain rotation of the thumb wheel 18 about the axis 29. This feature of the invention helps to keep graphics (not shown) on the thumb wheel 18 aligned with corresponding graphics on the knob 16 so that the graphically indicated output of the potentiometer 52 (as well as the actual output of the potentiometer 52) will not be changed by inadvertent rotation of the thumb wheel 18 upon intentional rotation of the knob 16.

From the above description of the invention, those skilled in the art will perceive improvements, changes and modifications. Such improvements, changes and modifications within the skill of the art are intended to be covered by the appended claims.

Having described the invention, the following is claimed:

1. Apparatus comprising:

a manually movable switch selector comprising a rotary knob and a thumb wheel, said rotary knob being configured for rotation about a first axis, said thumb wheel being supported on said rotary knob for rotation with said rotary knob about said first axis and for rotation relative to said rotary knob about a second axis perpendicular to said first axis;

an electrical device; and a mechanical linkage connected between said rotary knob and said thumb wheel so as to switch said thumb wheel into and out of actuatable engagement with said electrical device upon rotation of said rotary knob about said first axis.

2. Apparatus as defined in claim 1 wherein said mechanical linkage includes a braking device and is operative to move said braking device into engagement with said thumb wheel to restrain rotation of said thumb wheel about said second axis upon rotation of said rotary knob about said first axis.

3. Apparatus as defined in claim 2 wherein said electrical device comprises a rotary potentiometer.

4. Apparatus comprising:

a manually movable switch selector comprising a rotary knob and a thumb wheel, said rotary knob being configured for rotation about a first axis, said thumb wheel being supported on said rotary knob for rotation with said rotary knob about said first axis and for rotation relative to said rotary knob about a second axis perpendicular to said first axis; and a mechanical linkage connected between said rotary knob and said thumb wheel, said mechanical linkage including a braking device and being operative to move said braking device into engagement with said thumb wheel to restrain rotation of said thumb wheel about said second axis upon rotation of said rotary knob about said first axis.

5. Apparatus as defined in claim 4 wherein said braking device is elastomeric.

6. Apparatus as defined in claim 4 wherein said mechanical linkage is operative to switch said thumb wheel into and out of actuatable engagement with an electrical device upon rotation of said rotary knob about said first axis.

7. Apparatus comprising:

a manually movable switch selector comprising a rotary knob and a thumb wheel;

said rotary knob being configured for rotation about a first axis;

said thumb wheel being supported on said rotary knob for rotation relative to said rotary knob about a second axis perpendicular to said first axis; and a mechanical linkage connected between said rotary knob and said thumb wheel so as to switch said thumb wheel into and out of actuatable engagement with an electrical device upon rotation of said rotary knob about said first axis.

8. Apparatus as defined in claim 7 wherein said mechanical linkage includes a braking device and is operative to move said braking device into engagement with said thumb wheel to restrain rotation of said thumb wheel about said second axis upon rotation of said rotary knob about said first axis.

9. Apparatus comprising:

a manually movable switch selector comprising a rotary knob and a thumb wheel;

said rotary knob being configured for rotation about a first axis;

said thumb wheel being supported on said rotary knob for rotation relative to said rotary knob about a second axis perpendicular to said first axis; and a mechanical linkage being connected between said rotary knob and said thumb wheel, said mechanical linkage including a braking device and being operative to move said braking device into engagement with said thumb wheel to restrain rotation of said thumb wheel about said second axis upon rotation of said rotary knob about said first axis.

10. Apparatus as defined in claim 4 wherein said braking device is elastomeric.

* * * * *